US005328420A

United States Patent [19]

Allen

[11] Patent Number: 5,328,420

[45] Date of Patent: Jul. 12, 1994

[54] STAIR STEP EXERCISE MACHINE

[76] Inventor: Temple W. Allen, P.O. Box 6497, 10-2-2 Peterborg St., St. Thomas, V.I. 00801

[21] Appl. No.: 93,023

[22] Filed: Jul. 19, 1993

[51] Int. Cl.[5] ..... A63B 22/04

[52] U.S. Cl. ..... 482/52; 482/37; 482/908

[58] Field of Search ..... 482/52, 53, 54, 111, 482/42, 37, 51, 908

[56] References Cited

U.S. PATENT DOCUMENTS

| | | | |
|---|---|---|---|
| 3,497,215 | 2/1974 | Harrison et al. | 482/52 |
| 4,687,195 | 8/1987 | Potts | 482/52 |
| 5,120,050 | 6/1992 | Fowell | 482/52 |
| 5,145,475 | 9/1992 | Cares | 482/52 |
| 5,195,935 | 3/1993 | Fencel | 482/52 |

*Primary Examiner*—Stephen R. Crow

*Attorney, Agent, or Firm*—Millen, White, Zelano, & Branigan

[57] ABSTRACT

A stair step exerciser is mounted on a frame having horizontal and vertical components. A carriage comprised of a pair of side plates is pivoted to one end of a horizontal component and is retained at the other end in one of a series of vertical stops to selectively determine the angle of the carriage with respect to the frame. The carriage has pulleys at both ends which support the belts on which treads are pivoted at one end. The other end of the treads rest on one rail of a four bar linkage, which linkage expands as the carriage angle is decreased and collapses as the carriage angle is increased so as to always maintain the treads horizontal. A pair of hand cables are provided which move at substantially the same speed as the treads. The hand cables are mounted so as to be closer to the treads as the angle of the carriage increases and so as to move away from the treads as the angle of the carriage decreases.

10 Claims, 9 Drawing Sheets

STAIR STEP EXERCISE MACHINE

FIELD OF THE INVENTION

The present invention relates to stair step exercise machines. More particularly, the present invention relates to stair step exercise machines in which the machine may be adjusted to select the amount of force that the body must exert in utilizing the machines.

BACKGROUND ART

For various reasons, it has been proven feasible to make exercise devices relatively compact so that they can be utilized indoors. Normally, physiological benefits of walking and running require considerable space which has been traditionally available only outdoors and on a limited basis by indoor tracks. Perhaps three decades ago, treadmills were developed, primarily for medical purposes, so that physiological phenomenon, such as heart rates, could be conveniently measured. Since that time, treadmills have also gained wide acceptance as exercise devices because they require little space, are easy to calibrate and take measurements for physiological purposes and because they may be used regardless of the weather.

The benefits of stair climbing for cardiovascular exercise has long been recognized. Athletes such as rowers and football players increase their strength and endurance by running up stadium stairs. Starting in the 1960's, the patent literature, as exemplified by U.S. Pat. No. 3,497,215 to Harrison et al., includes a number of exercise escalators or stair steppers, wherein treadmills are given a vertical component so that the user combines normal walking, or perhaps even jogging, with the task of overcoming additional gravitational forces.

These exercise escalators or stair step-type treadmill exercisers now include devices such as brakes in order to adjust the force required of the person by the exercise device and to provide various readouts of interest to the operator. Such devices are perhaps exemplified by U.S. Pat. No. 4,687,195 to Potts.

In U.S. Pat. No. 5,145,475 to Cares, the concept of exercising the arms and upper body simultaneously with exercising the legs as well as the heart and lungs is now of considerable interest. This in part results from a recognition of the physiological benefits of cross-country skiing which are duplicated for indoor exercising with devices such as the NORDITRACK ®. However, the Nordatrak ®-type machine does not add an additional gravitational component to the existing gravitational component which is overcome when walking or running horizontally.

While the prior art discloses stair stepping types of exercising devices, the prior art has yet to provide a device which can vary the amount of gravitational force which the exerciser must overcome in combination with exercising the upper body and torso as well as the lower body.

SUMMARY OF THE INVENTION

It is a feature of the instant invention to provide a new and improved stair step exerciser in which one may exercise the arms and upper torso as well as the legs and lower torso simultaneously. It is an additional feature of the present invention to provide a new and improved stair step-type exerciser in which the inclination or attitude of the exerciser is adjustable to select the gravitational component which is overcome when utilizing the exerciser.

In view of these features and other features, the instant invention is directed to a stair step-type exerciser in which the slope that the user works against when "climbing" steps of the exerciser is adjustable to provide a selected gravitational component.

In accordance with another feature of the instant invention, the stair step-type exerciser includes an arrangement for exercising one's arms and upper body while "climbing" the stair stepper exercise device.

In accordance with a preferred embodiment of the present invention, the stair step exerciser embodies both the concept of adjusting the slope of the stair stepper while providing exercise for the arms and upper torso of the user so that both exercises cooperate to contribute to a single exercise regime.

With respect to a further aspect of the instant invention, exercise for the arms and upper body is provided by a pair of cables which extend in spaced relation to, but proximate, steps or treads of the device and which move closer to the steps or treads as the slope of the steps increases.

In order to maintain horizontal orientation of treads comprising the stair step exerciser, the treads are pivoted proximate a front edge to a pair of parallel carriages and engage a pair of parallel, four-bar linkages within the carriages disposed at opposite free inner edges of the treads. The four-bar linkage moves towards a collapsed mode as the carriages are elevated to increase the slop of the stair step exerciser and move toward an expanded mode as the carriages are lowered to decrease the slope thereof. Moreover, the treads increase in vertical distance from one another as the slope increases and move closer in vertical displacement as the slope decreases.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
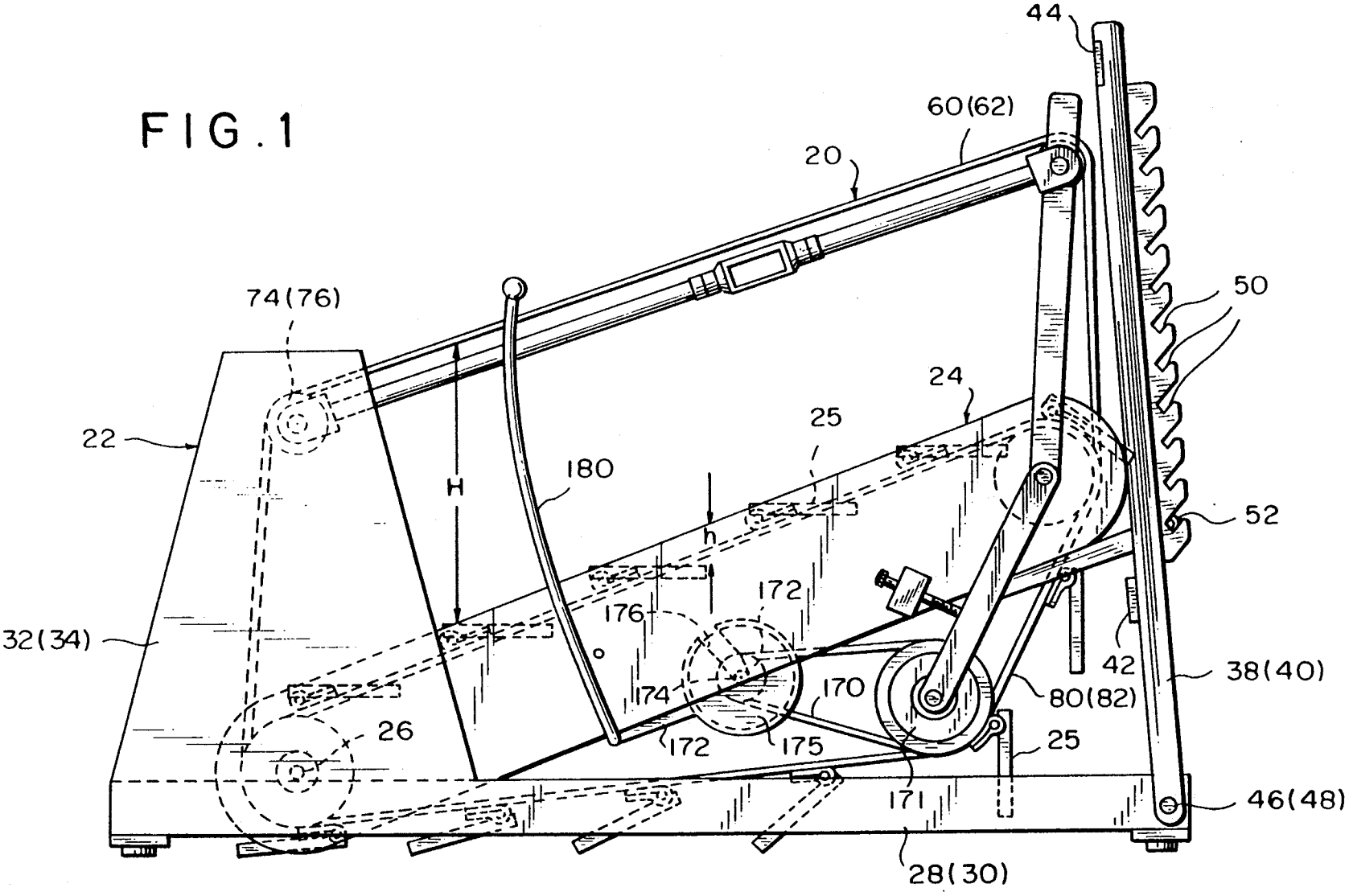
FIG. 1 is a side view of the stair step exerciser configured in accordance with the instant invention and positioned in a slight slope mode.
Figure 2:
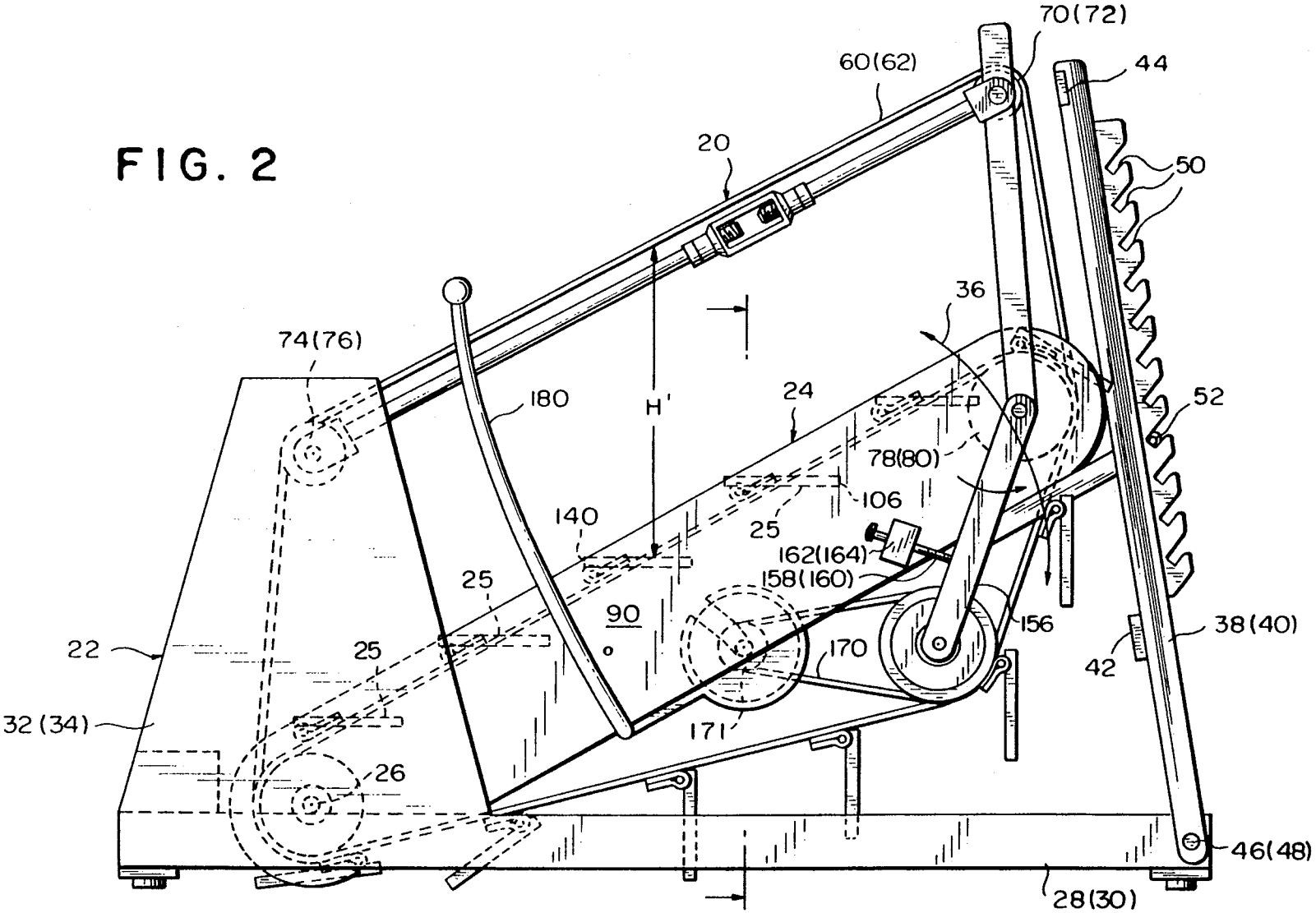
FIG. 2 is a side view similar to FIG. 1 but showing the stair step exerciser positioned in an intermediate slope mode.
Figure 3:
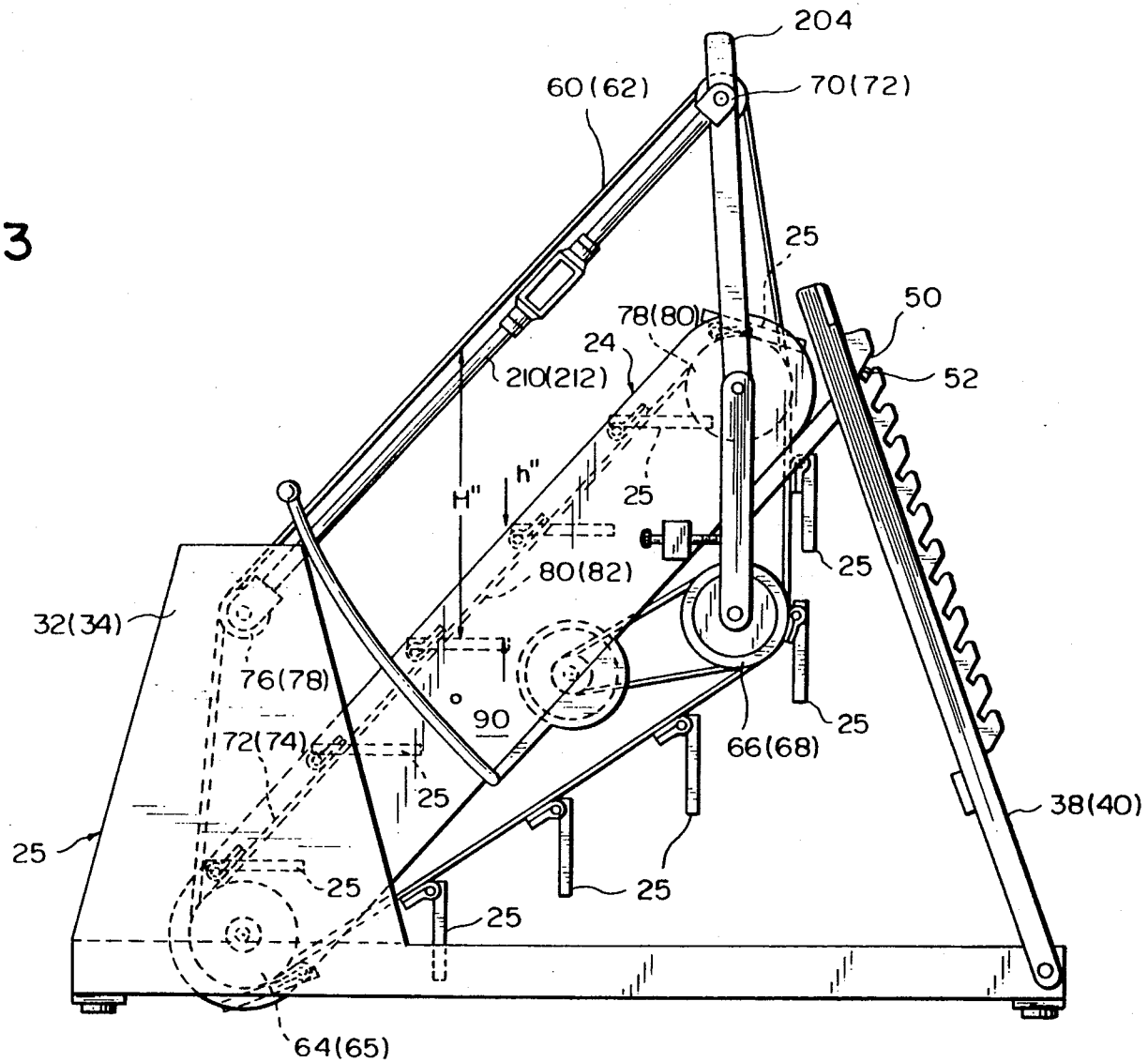
FIG. 3 is a view similar to FIGS. 1 and 2 but showing the stair step exerciser positioned in a high slope mode.

Referring now primarily to FIGS. 1-3, there is shown a stair step exerciser 20 configured in accordance with the principles of the instant invention. The stair step exerciser 20 is comprised of a frame 22 upon which a stair step assembly 24 is pivoted on an axle 26. The axle 26 is fixed with respect to a pair of horizontal frame members 28 and 30 and a pair of vertical frame members 32 and 34 so that the tread assembly 24 can selectively move through arc 36. A pair of vertical struts 38 and 40, fixed to move in unison by cross-beams 42 and 44, are pivoted at pivots 46 and 48 to the horizontal frame members 28 and 30. Each of the vertical struts 38 and 40 has a plurality of notches 50 acutely oriented to receive a bar 52 which extends laterally with respect to the tread assembly 24. The slope or attitude of the tread assembly 24 can be adjusted by placing a bar 52 in a selected slot 50. For example, in FIG. 1, the slope is relatively gradual because the bar 52 is placed in the bottom slot 50. In FIG. 2, the slope is intermediate because the lateral bar 52 is placed in a slot 50 intermediate the top and bottom of the array of slots. In FIG. 3, the slope is relatively steep because the bar 52 is placed in the top slot 50. Accordingly, the person utilizing the exercise device can increase the exertion required for each step per selected unit time by increasing the attitude or slope of the tread assembly 24. As is readily apparent from comparing the heights h, h' and h'' between the treads 25 of FIGS. 1, 2 and 3, respectively, that as the slope of the tread assembly 24 increases, so does the vertical distance between the treads. Consequently, as the slope is increased, so is the amount of knee flexure and the exertion expended to climb to the next step.

A pair of cables 60 and 62 are disposed proximate opposite sides of the stair assembly 24. The cables 60 and 62 may be gripped by the exerciser's hand and pulled while the exerciser climbs the treads 25 in order to exercise the arms and upper body. The cables 60 and 62 are trained around a pair of first pulleys 64 and 66, a pair of second pulleys 66 and 68, a pair of third pulleys 70 and 72 and a pair of four pulleys 74 and 76. The cables 60 and 62 also engage pairs of pulleys 78 and 79 disposed at the top of the tread assembly 24. As is seen by comparing the heights H, H', H'' in FIGS. 1, 2 and. 3, respectively, as the slope of the tread assembly 24 increases, the distances H, H' and H'' decrease. Consequently, the configuration of the system changes to conform to the ergonomics of the user so that the user's hands and forearms are always a substantial distance in front of the user as opposed to being lateral of or behind the user.

The steps 25 are mounted on pairs of endless flexible tread carriers 80 and 82 in the form chains or cogged belts which are trained around the pulleys 64 and 65 and 78 and 79 which are configured as sprockets. While chains may be used instead of cogged belts for the endless flexible carriers 80 and 82, cogged belts may be preferred because cogged belts are quieter. In a suggested configuration, the sprockets comprising pulleys 64, 65, 78 and 79, or sprocket portions if the pulleys are sprockets, may be made of a resinous material, preferably reinforced, while the endless flexible carriers 80 and 82 are chains made of steel. Since the hand cables 60 and 62 are also trained around the pulleys 64, 66 and 78, 79 (or pulley portions if the pulleys are sprockets), the hand cables 60 and 62 travel at the same speed as treads 25 carried by endless flexible carriers 80 and 82.

Figure 4:
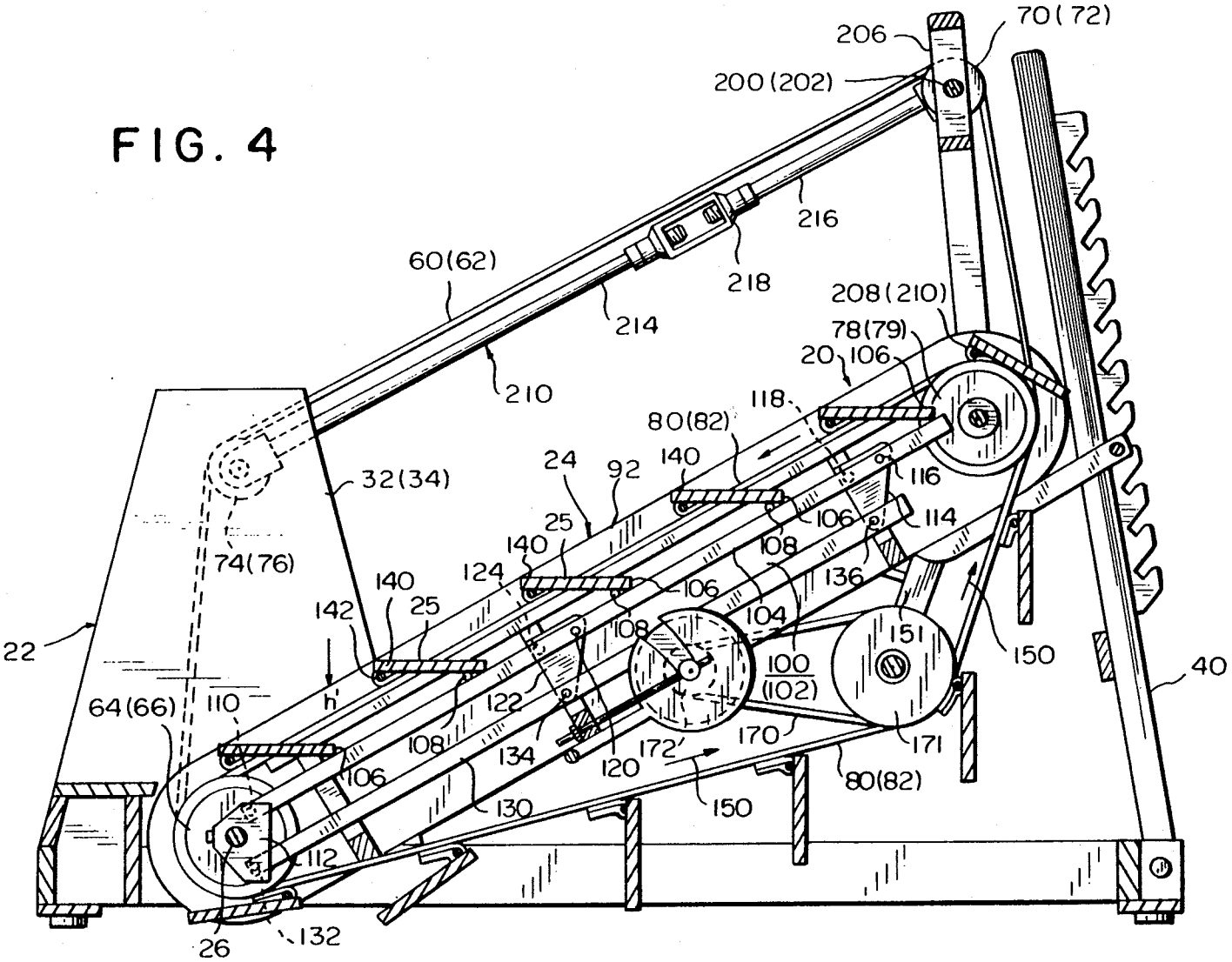
FIG. 4 is a side elevation of the stair step exerciser of FIGS. 1–3, showing the major internal working parts thereof.

Referring now to FIG. 4 in combination with FIGS. 1, 2 and 3, it is seen that the tread assembly, including the treads 25 and the flexible carriers 80 and 82, are disposed between a pair of spaced side plates 90, 92 which function in a manner similar to stair carriages. In FIG. 4, the side plate 90 is deleted to more clearly show how the endless flexible carriers 80 and 82 are trained around the pulleys 64, 66 and 78, 79. In order to maintain the attitude of each tread 25 horizontal, a pair of four-bar linkages 100 and 102 are disposed between the side plates 90 and 92. The four bar linkages 100 and 102 each have an upper rail 104 which supports the free ends 106 of each tread 25. Contact between the free ends 106 of the treads 25 and the rails 104 may be made by rollers 108 or perhaps other friction-reducing concepts. The rail 104 is pivoted by a pin 110 to a fixed bell crank 112 which is fixed so as not to rotate about the axle 26. In other words, the bell crank 112 is fixed with respect to the frame 22. Proximate the top end thereof, the rail 104 is pivoted to a second bell crank 114 by pivot pin 116. The bell crank 114 is pivoted with respect to the tread assembly 24 by a pin 118 which is fixed to the side rail 92. Intermediate its ends, the rail 104 is pivoted by a pin 120 to a third bell crank 122 that is in turn pivoted by a pivot 124 to the side plate 92. A bottom strut 130 is pivoted at pin 132 to the fixed bell crank 112 by pin 134 through the intermediate bell crank 122 and by pin 136 to the top bell crank 114. The strut 130 is substantially parallel to the rail 104 and is held in parallel relation with respect thereto by the bell cranks 112, 122 and 114. Since the bell crank 112 is fixed with respect to the frame 22 and the bell cranks 122 and 114 are pivoted on the side plate 92 of the tread assembly 24, the rail 104 collapses toward the strut 130 as the platform is raised towards the maximum slope position of FIG. 3 and moves apart as the slope is decreased when the tread assembly 24 is moved toward the position of FIG. 1. Consequently, as the front edge 140 on each of the treads 25 moves upwardly with respect to the frame 22, the trailing edges 106 move downwardly, thereby maintaining the horizontal orientation of the treads. In order for this system to work, each tread 25 is pivoted on the flexible carriers 80 and 82 by pivots 142. While only the four-bar linkage 100 is shown in detail in FIG. 4, the four bar linkage 102 positioned proximate plate 90 works in an industrial fashion.

As the treads 25 are stepped upon, the endless flexible carriers 80 and 82 move in the direction of arrows 150. In order to properly tension the flexible carriers 80 and 82, pulleys 66 and 68 are mounted on links 156 which are co-pivoted with but freely rotatable with respect to pulleys 78 and 79. The links 156 are urged to rotate in a counterclockwise direction by screw adjusters 158 and 160 threaded into blocks 162 and 164 on side plates 90 and 92, respectively. As the adjuster screws 158 and 160 advance out of the screw blocks 162 and 164, the links 156 and 157 are urged counterclockwise to further tension the endless flexible carriers 80 and 82.

Figure 5:
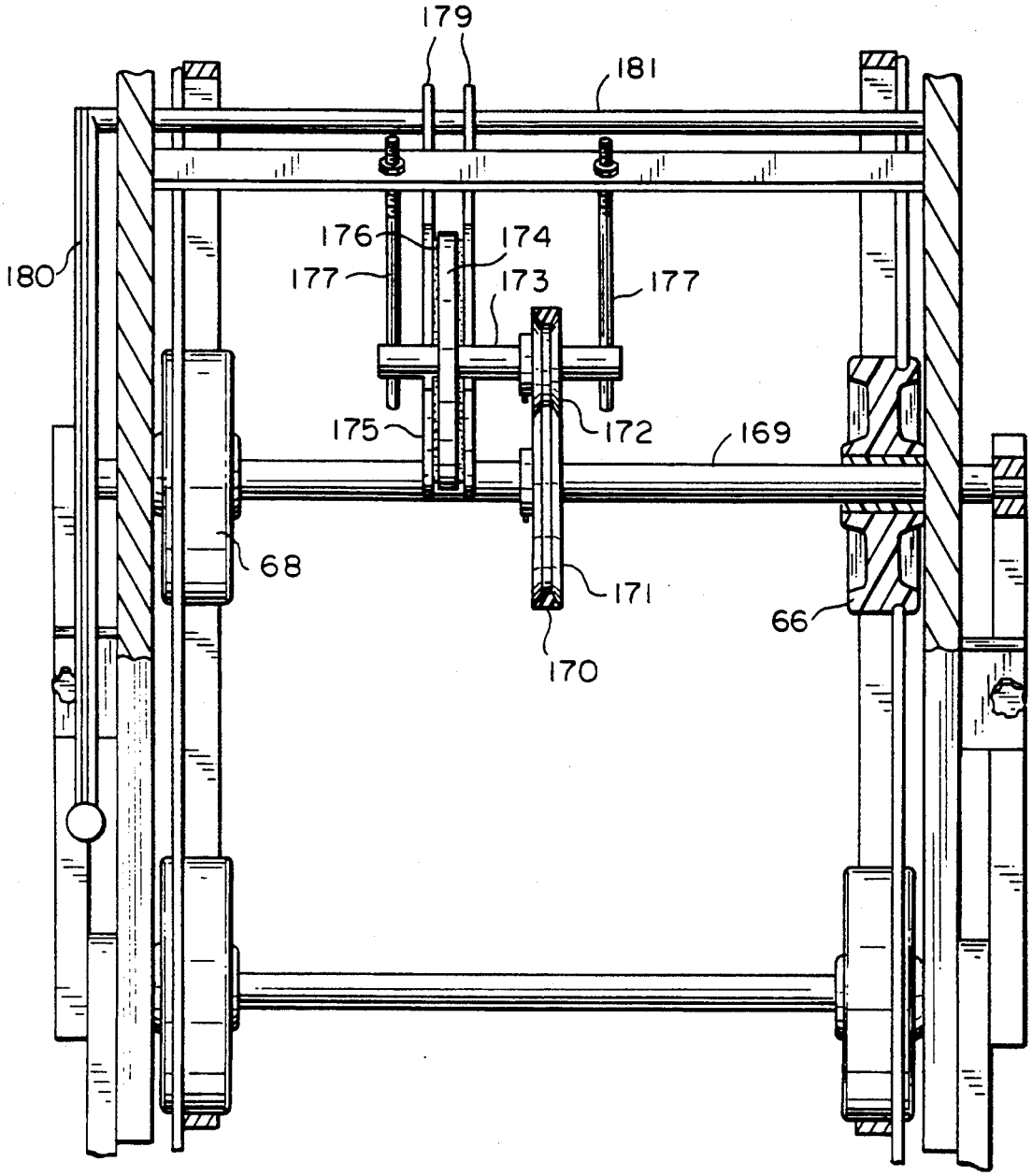
FIG. 5 is a bottom view of the stair step exerciser showing components for a brake operator.
Figure 6:
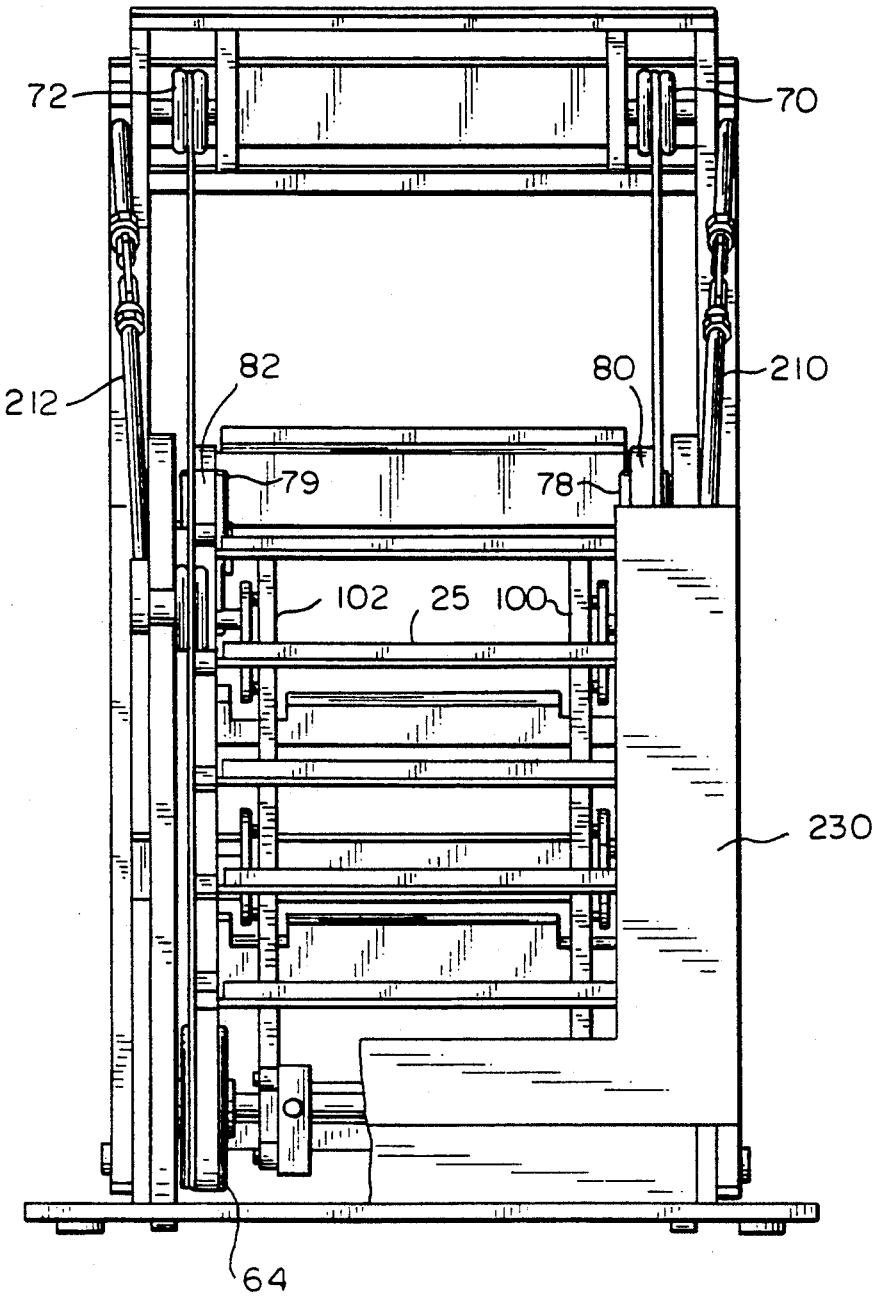
FIG. 6 is a front view of the stair step exerciser of FIGS. 1–5.

As is seen in FIG. 5, in order to provide braking, the pulleys 66 and 68 are each mounted on an axle 169 connected by a belt 170 mounted on pulley wheel 171 and 172.

The pulley wheel 171 is mounted on the axle 169 while the pulley wheel 172 is mounted on an axle 173 fixed to a friction brake 174 disk. The friction brake disk 174 is mounted in a friction housing 175 having friction material 176 therein. The axle 173 is mounted on rods 177 and is received through a slot 178 in the friction housing 175 (see also FIG. 4.). The friction housing is connected by struts 179 to braking handle 180 via a unitary bar 181. When the braking handle 180 is pressed, the belt 170 is tensioned, activating braking by causing the brake disk 174 to work against the friction material 176 in the friction housing 175.

In order to ensure that the hand cables 60 and 62 are properly tensioned, pulleys 74 and 76 are fixed to the vertical frame members 32 and 34 while the pulleys 70 and 72 rotate about axles 200, 202 and links 204,206 are pivoted by pivots 208,210 on side plates or carriages 90 and 92, respectively. The position of the links 204,206 with respect to the vertical frame members 32 and 34 is adjusted by pairs of struts 210 and 212, each of which has lower and upper portions 214 and 216 threaded to one another by a nut 218 which, when turned in a one direction, shorten the struts 210 and 212 and which, when rotated in the opposite direction, lengthen the struts. In this way, the proper tension can be maintained on the hand cables 60 and 62.

Figure 7:
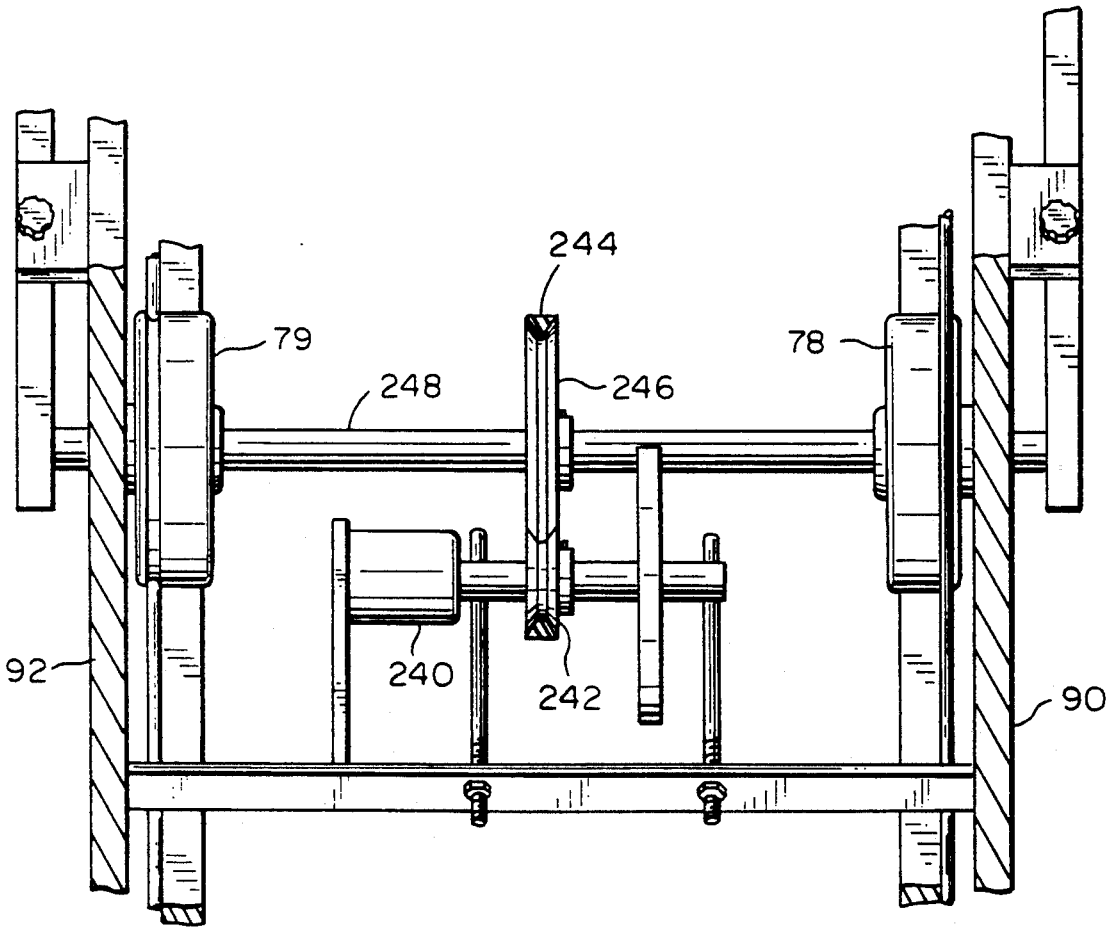
FIG. 7 is a bottom view of the stair step exerciser, wherein a motor is utilized to add a power component to the stair step exerciser.

While the aforedescribed stair step exerciser 20 is manually operable with the user working against gravity and the braking mechanism provided by belt 70, the endless flexible carriers 80 and 82 may be driven by an electric motor 240 such as the electric motor in FIG. 7 which drives a pulley 242 and a belt 244 looped around a pulley 246. The pulley 246 drives a shaft 248 coupled to the pulleys 78 and 79.

Optionally, the links 206 and 204 may provide a support frame to which monitoring instruments may be connected to appraise the exerciser of parameters such as time, speed, calories consumed and the like. In addition, the instruments may include respiratory and heart rate readouts as well as other medical indicators.

Figure 8:
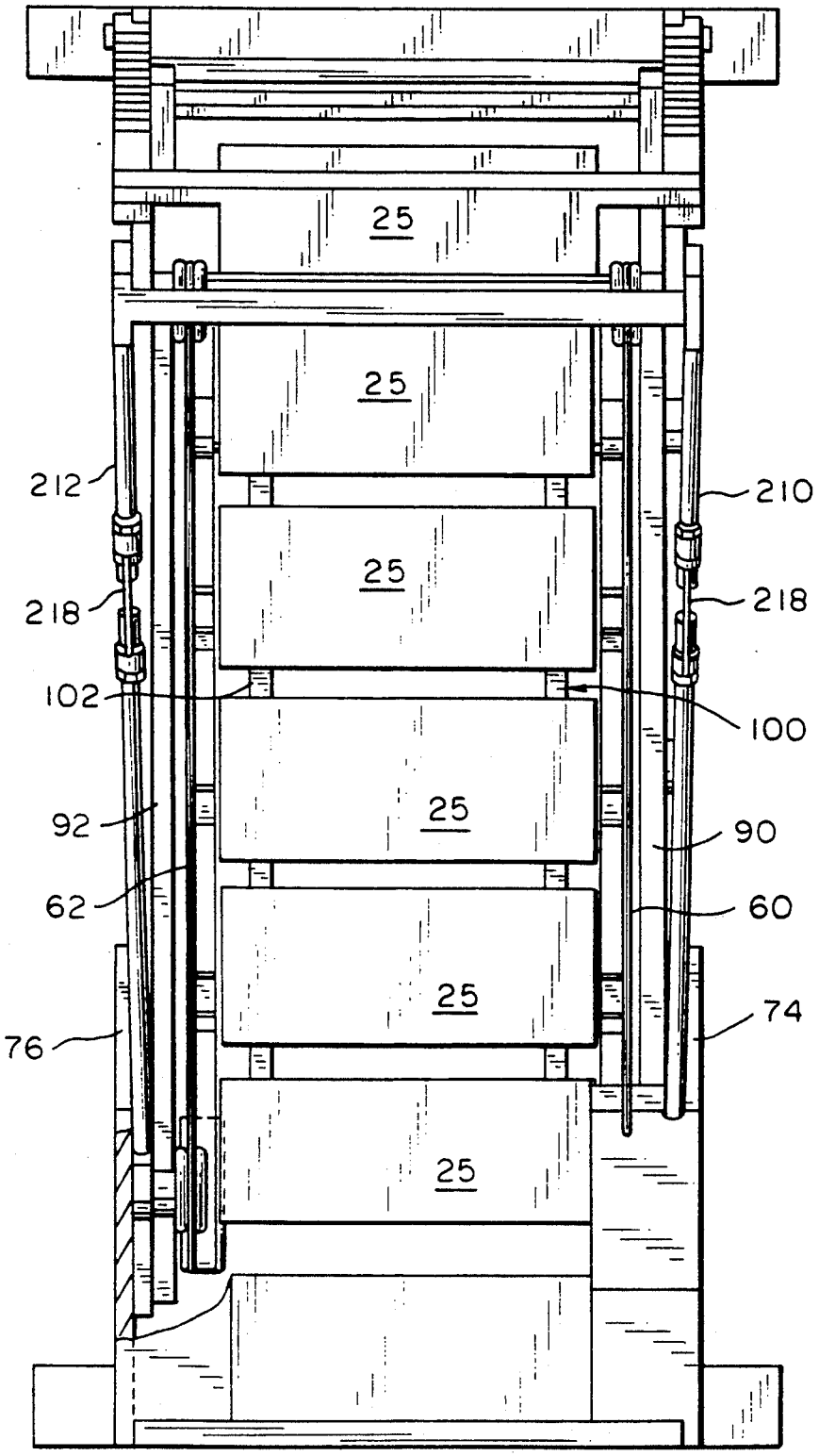
FIG. 8 is a top view of the stair step exerciser of FIGS. 1–7.
Figure 9:
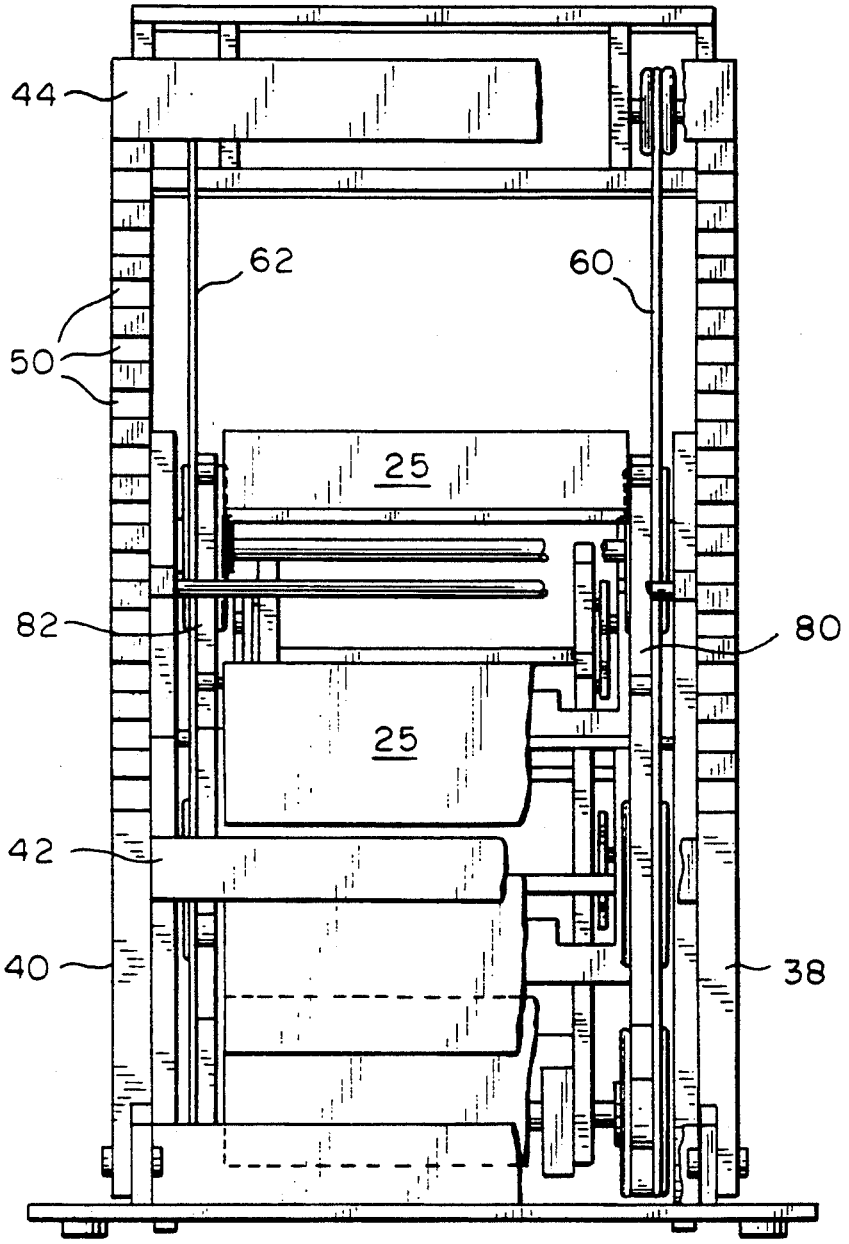
FIG. 9 is a back view of the stair step exerciser of FIGS. 1–8.

As is seen in FIGS. 8 and 9, the stair step exerciser has a generally equilateral configuration wherein generally the same structures are used on one side of the exerciser as the other.

In summary, the aforedescribed arrangement discloses a stair step exerciser 10 in which the height of each tread 25 may be increased or decreased as well as the angle "climbed" is increased or decreased. In addition, the hand cables 60 and 62 provide exercise for the arms and upper body which can supplement or complement the leg exercise provided by the treads 25 as they move either under the weight of the user or by operation of the motor 240.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A stair step-type exerciser comprising:

a stationary frame having horizontally and vertically extending components;

a stair carriage having a plurality of treads mounted thereon and being movable with respect thereto, the stair carriage being movable with respect to the frame at one end and supported with respect to the frame at the other end, wherein an angle of the carriage with respect to the frame is selected; wherein the treads are mounted on cogged belts trained around sprockets mounted between side plates the cogged belts at one end and engage leveling means at the other end which leveling means keeps the treads horizontal regardless of the angle of the carriage with respect to the frame.

2. The stair step exerciser of claim 1, further including means for exercising the upper arms associated with the adjustable carriage and means for bringing the upper arm exerciser into closer proximity with the treads as the angle of the carriage is increased.

3. The stair step exerciser of claim 2, wherein the belts are engaged by a brake to load the belts against the user's weight.

4. The stair step exerciser of claim 1, wherein the leveling means comprising at least one four-bar linkage which expands as the angle of the carriage with respect to the frame decreases and collapses as the angle of the carriage with respect to the frame increases.

5. A stair step-type exerciser comprising:

a frame with horizontal and vertical components, one of the vertical components being pivoted thereto and having a plurality of supporting elements at various elevations thereon;

a carriage pivoted at one end to the frame and being selectively coupled at the other end to a selected supporting element on the vertical strut, the carriage including a plurality of treads pivotally mounted on a flexible carrier trained around pulleys at opposite ends of the carriage;

means disposed on the carriage for maintaining the treads horizontal regardless of the angle of the carriage with respect to the horizontal component of the frame; and means associated with the carriage for providing hand holds for a user; wherein the means for providing hand holds is a cable which moves at the same speed as the treads.

6. The stair step exerciser of claim 5, further including means for moving the cable closer to the treads when the angle is increased.

7. The stair step exerciser of claim 6, wherein the means for maintaining the treads horizontal regardless of the angle of the carriage includes a four bar linkage engageable by the free edges of the treads, wherein the four bar linkage collapses as the angle is increased and expands as the angle decreases.

8. The stair step exerciser of claim 7 further including a motor coupled to the flexible carrier for moving the flexible carrier to advance the treads upwardly.

9. The stair step exerciser of claim 5 further including a motor coupled to the flexible carrier for moving the flexible carrier to advance the treads upwardly.

10. The stair step exerciser claim 5, wherein the flexible carrier is a cogged belt or chain and wherein the pulleys include sprockets.

* * * * *